US011719449B2

(12) United States Patent
Chen et al.

(10) Patent No.: US 11,719,449 B2
(45) Date of Patent: Aug. 8, 2023

(54) SYSTEMS FOR REFRIGERATING AN ENCLOSURE

(71) Applicant: Mina Sagar, New York, NY (US)

(72) Inventors: Kuo-mei Chen, Kaohsiung (TW); Sanjay Sagar, New York, NY (US); Hsin D. Chen, New York, NY (US)

(73) Assignee: Mina Sagar, New York, NY (US)

( * ) Notice: Subject to any disclaimer, the term of this patent is extended or adjusted under 35 U.S.C. 154(b) by 242 days.

(21) Appl. No.: 16/572,620

(22) Filed: Sep. 17, 2019

(65) Prior Publication Data

US 2021/0080134 A1 Mar. 18, 2021

(51) Int. Cl.
*F24F 5/00* (2006.01)
*F25B 19/00* (2006.01)

(52) U.S. Cl.
CPC ..... *F24F 5/0035* (2013.01); *F24F 5/001* (2013.01); *F25B 19/00* (2013.01); *F25B 2339/041* (2013.01); *F25B 2339/047* (2013.01)

(58) Field of Classification Search
CPC ..... F25B 19/00; F25B 2339/041; F25B 2339/047; F24F 5/0035; F24F 5/001
See application file for complete search history.

(56) References Cited

U.S. PATENT DOCUMENTS 2,233,633 A * 3/1941 Mollenberg ..... F25B 49/027 62/178
2,238,808 A * 4/1941 Dube ..... F25B 49/027 62/181
2,764,876 A * 10/1956 Parcaro ..... F25B 39/00 62/434
4,107,942 A 8/1978 Fairman
5,317,883 A 6/1994 Newman
5,584,190 A 12/1996 Cole
5,855,121 A 1/1999 Byrd et al.
6,584,784 B2 7/2003 Gaul
10,723,634 B1 * 7/2020 Chen ..... C02F 1/265
(Continued)

FOREIGN PATENT DOCUMENTS

WO WO-2015068874 A1 * 5/2015 ..... F28B 1/02

OTHER PUBLICATIONS

Partial English Machine Translation: WO2015068874A1. Accessed Oct. 2021.*

*Primary Examiner* — Tavia Sullens
(74) *Attorney, Agent, or Firm* — Kanika Radhakrishnan; Evergreen Valley Law Group

(57) ABSTRACT

The present disclosure provides a refrigeration system. The system includes an evaporator unit having a housing configured to receive the refrigerant and an air inlet port configured to receive air. A porous material is disposed within the housing for defining a first compartment and a second compartment. A compressor unit is fluidically coupled to the housing and configured to induce an evacuation action within the housing, which enables air to enter the housing from the ambient surroundings via the air inlet port. The porous material is positioned above the air inlet port for allowing the air into the housing therethrough. The routed air disperses within the housing to form air bubbles, inducing turbulent motion of the refrigerant for converting the refrigerant into a mixture of refrigerant vapors and a cooled refrigerant. A heat exchanger is configured to refrigerate the enclosure.

17 Claims, 3 Drawing Sheets

(56) References Cited

U.S. PATENT DOCUMENTS

| | | | | |
|---|---|---|---|---|
| 2005/0210885 | A1 | 9/2005 | Pereira et al. | |
| 2012/0037338 | A1* | 2/2012 | Pearson ..... | F28F 25/00 165/67 |
| 2013/0118887 | A1 | 5/2013 | Frolov et al. | |
| 2015/0114017 | A1 | 4/2015 | Hayashi et al. | |
| 2019/0063801 | A1 | 2/2019 | Miyoshi et al. | |

* cited by examiner

SYSTEMS FOR REFRIGERATING AN ENCLOSURE

TECHNICAL FIELD

The present disclosure relates generally to vapor compression systems such as refrigeration systems and air-conditioning systems and, more particularly to, vapor compression systems capable of utilizing water as a refrigerant.

BACKGROUND

In conventional refrigeration systems, particularly vapor compression refrigeration systems, synthetic refrigerants, such as but not limited to, chlorofluorocarbons (CFC), hydrochlorofluorocarbons (HCFC) and hydrofluorocarbons (HFC) are employed for ease of availability and favorable thermal properties for refrigeration. Consequently, the resultant refrigeration systems are characterized with improved energy efficiency and thermal performance However, the use of synthetic refrigerants, discharge into atmosphere that are harmful to the earth's ozone layer, leading to ozone layer depletion and global warming, which is catastrophic.

To overcome the aforementioned limitation, technology has paved way for use of refrigerants such as ammonia (R717), water (R718) and the like, which are configured with a lower potential to damage the ozone layer and global warming. Among these refrigerants, R718 is chemically stable, non-flammable, physiologically harmless and abundantly available for access. However, due to the physical properties of R718 in its refrigeration temperature range (i.e. 0° C. to 10° C.), utilization of R718 as the refrigerant poses unique challenges. One of the physical properties which is the vapor pressure, that is required to be maintained for use as the refrigerant is 12 mbar for 10° C., which is less than two thousandths with that of ammonia at the same temperature. Moreover, the volumetric flow rate of the water that is to be compensated with its working pressure is much higher (for e.g., 230-fold larger at 10° C.) than ammonia for the same refrigeration capacity. To comply with these requirements an evaporator, an intermediate cooler, a condenser and two-stage turbo compressors inside a vacuum tight enclosure is required to be installed. Such requirement is technologically demanding, and their bulky dimensions can at most serve large refrigeration facilities. Beyond these challenges, the complete processes of evaporation, compression, transportation and condensation of water vapors should be carried out under a good vacuum. Consequently, additional roots and oil-less screw vacuum pumps should be installed to maintain this working condition. These indispensable vacuum devices are costly and deteriorate the performance of prior art water chillers.

Therefore, there is a need for techniques which can overcome one or more limitations stated above in addition to providing other technical advantages.

SUMMARY

Various embodiments of the present disclosure provide a refrigeration system. The system including an evaporator unit including a housing configured to receive water and including an air inlet port configured to route air into the housing. A compressor unit is fluidically coupled with the housing and is configured to maintain a vacuum condition or induce an evacuation action within the housing. The evacuation action enables air to enter the housing from the ambient surroundings via the air inlet port. A porous material is disposed within the housing for defining a first compartment and a second compartment within the housing. The first compartment is configured to receive the water and the second compartment configured to receive the air through the air inlet port. The porous material is positioned above the air inlet port for allowing the air into the housing through the porous material. The air routed through the porous material disperses within the housing to form air bubbles. The air bubbles induce turbulent mixing between phase boundaries of water molecules and air molecules within the housing, wherein interfacial areas of the air bubbles and the turbulent mixing enhance evaporation rate of the water thereby converting a portion of the water into water vapors. The water vapors on discharging from the housing cools the portion of the water via evaporative cooling to form a cooled water. A heat exchanger unit is fluidically coupled to the housing and to an enclosure. The heat exchanger unit is configured to refrigerate the enclosure. The pump also ensures that mixture of the air and the water vapors is expelled from the housing to the ambient environment or to a condenser, suitably.

In another embodiment, the present disclosure also provides an air conditioning system. The system including an evaporator unit including the housing configured to receive water and including the air inlet port configured to route air into the housing. The porous material is disposed within the housing for defining the first compartment and the second compartment within the housing. The first compartment is configured to receive the water and the second compartment configured to receive the air through the air inlet port. The porous material is positioned above the air inlet port for allowing the air into the housing through the porous material. The air routed through the porous material disperses within the housing to form air bubbles. The air bubbles induces turbulent mixing between phase boundaries of water molecules and air molecules within the housing, wherein interfacial areas of the air bubbles and the turbulent mixing enhance evaporation rate of the water thereby converting a portion of the water into water vapors. The water vapors on discharging from the housing cools the portion of the water via evaporative cooling to form a cooled water. The heat exchanger unit is fluidically coupled to the housing and to an enclosure. The heat exchanger unit is configured to air-condition the enclosure.

BRIEF DESCRIPTION OF THE FIGURES

The following detailed description of illustrative embodiments is better understood when read in conjunction with the appended drawings. For the purpose of illustrating the present disclosure, exemplary constructions of the disclosure are shown in the drawings. However, the present disclosure is not limited to a specific device or a tool and instrumentalities disclosed herein. Moreover, those in the art will understand that the drawings are not to scale. Wherever possible, like elements have been indicated by identical numbers.

Figure 1:
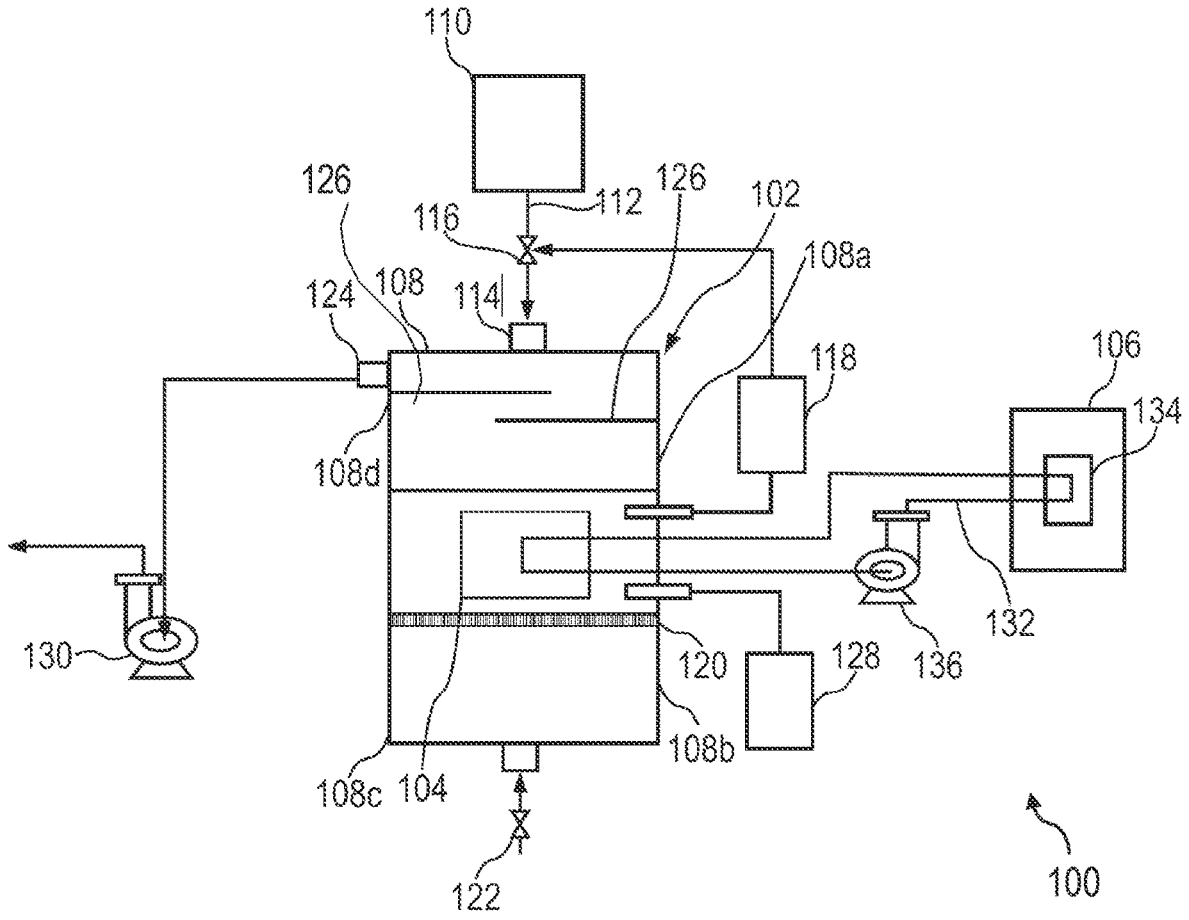
FIG. 1 is a schematic view of a refrigeration system, in accordance with an example embodiment of the present disclosure.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Reference in this specification to "one embodiment" or "an embodiment" means that a particular feature, structure, or characteristic described in connection with the embodiment is included in at least one embodiment of the present disclosure. The appearance of the phrase "in an embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or in conjunction with each other, one skilled in the art will appreciate that many of these features can be provided independently of other features. Accordingly, this description of the present disclosure is set forth without any loss of generality to, and without imposing limitations upon, the present disclosure.

Overview

Various embodiments of the present disclosure provide a refrigeration system. The refrigeration system is capable of utilizing water as a refrigerant, without a need for cumbersome equipment required for maintaining working condition within the system for using water as the refrigerant. The system is therefore cost-effective in operation and maintenance while improving the overall coefficient of performance (COP) or energy efficiency ratio (EER).

The system includes an evaporator unit having a housing configured to receive water. The housing may be fluidically connected to a reservoir for receiving water. The housing includes an air inlet port, preferably positioned at a bottom portion of the housing, configured to route air into the housing. A compressor unit is fluidically coupled with the housing and is configured to maintain a vacuum condition or induce an evacuation action within the housing. The evacuation action enables air to enter the housing from the ambient surroundings via the air inlet port. A porous material is disposed within the housing, for defining a first compartment and a second compartment. The first compartment is configured to receive the water, as such, the first compartment may be fluidically connected with the reservoir for receiving the water. The second compartment is configured to receive the air routed via the air inlet port, due to the evacuation action of the pump. The porous material is positioned above the air inlet port for allowing the air into the housing through the porous material. The air routed through the porous material disperses within the housing to form air bubbles. The air bubbles induces turbulent mixing between phase boundaries of water molecules and air molecules within the housing, wherein interfacial areas of the air bubbles and the turbulent mixing enhance evaporation rate of the water, thereby converting a portion of the water into water vapors. The water vapors when discharged from the housing via the compressor unit or the pump, cools the remaining portion of the water via evaporative cooling to form cooled water. The cooled water settles on the porous material. A heat exchanger unit is coupled to the housing and to an enclosure, which may be a fluid container unit, a food storage compartment or an indoor space, via a conduit or a pipe. The conduit includes water, which is circulated between the evaporator and the enclosure for heat transfer therebetween for refrigeration.

The system may also include a condenser unit, fluidically coupled to the housing for receiving the water vapors. The condenser unit is configured to receive a mixture of the air and the water vapors from the housing via the compressor unit. The compressor unit maintains a vacuum condition in the housing, for ensuring routing of the water vapors from the housing to the condenser unit. In one configuration, the compressor unit may maintain or induce sufficient pressure difference between the condenser unit and the housing for ensuring routing of the water vapors from the housing to the condenser unit. The condenser unit is configured to condense the water vapors to the water for recirculation within the system. This configuration ensures recirculation of the water, thereby mitigating the need for fresh water in each cycle of operation of the system. Thus, if the water source is from municipal tap, the water can be recirculated in the system based on the above configuration.

The present disclosure also provides an air-conditioning system for air-conditioning the enclosure or the indoor space. The air-conditioning system may be controlled by a control unit, to ensure selective increase and decrease in the temperature of the indoor space.

Various embodiments of a refrigeration system are explained below in a detailed manner, herein with reference to FIG. 1 to FIG. 3.

FIG. 1 illustrates a schematic view of a refrigeration system 100, in one exemplary embodiment of the present disclosure. The refrigeration system 100 (hereinafter referred to as 'system 100') is configured to utilize 'water' (or 'R718') as a refrigerant, without utilizing cumbersome equipment for maintaining working condition of the system 100 for using water as the refrigerant. The system 100 broadly includes an evaporator unit 102, a heat exchanger unit 104 and an enclosure 106.

The evaporator unit 102 includes a housing 108 configured to receive water. The housing 108 may be fluidically coupled to a reservoir 110 for receiving the water. The reservoir 110 may be a tank containing the water body, a pond, a sea or an ocean as per requirement. The housing 108 may be fluidically coupled to the reservoir 110 via a conduit 112 for receiving the water. The conduit 112 is fluidically coupled to an evaporator inlet port 114 for supplying the water from the reservoir 110. A valve 116 may also be incorporated in the conduit 112 for controlling the flow of the water into the housing 108. The valve 116 may be communicably coupled or associated with a control unit (not shown in Figures). The control unit may operate the valve 116 for supplying the water into the housing 108 as per requirement. In one implementation, the control unit operates the valve 116 based on the level of the water within the housing 108. That is, if the level of the water in the housing 108 is lower than a pre-set limit, the valve 116 is operated to an open position (not shown in Figures) for supplying the water. A fluid level sensor 118 may be mounted to the housing 108 for determining the level of the water therein. In one configuration, the valve 116 may be one of a directional control valve or shut-off valve or any other valve as per design feasibility and requirement. In another configuration, the reservoir 110 may be integrated within the housing 108 (not shown in Figures).

A compressor unit or a pump 130 is fluidically coupled with the housing 108 and is configured to maintain a vacuum condition or induce an evacuation action within the housing 108. The evacuation action enables air to enter the housing 108 from the ambient surroundings via an air inlet port 122. Further, the evaporator unit 102 includes a porous material 120 disposed within the housing 108, particularly towards a bottom portion 108*c* of the housing 108. The porous material 120 is configured to divide or split the housing 108 into a first compartment 108*a* and a second compartment 108*b*. The first compartment 108*a* is configured to receive the water, while the second compartment 108*b* is configured to receive air through the air inlet port 122 configured in the housing 108. In one implementation, as the porous material 120 is mounted towards the bottom portion 108*c* of the housing 108, the first compartment 108*a* is configured with a larger volume than the second compartment 108*b*. In another implementation, the volume of the first compartment 108*a* and the second compartment 108*b* may be selected based on the required volume of the water, the type of the evaporator unit 102, a required cooling rate or any other suitable parameter as per feasibility and requirement. The porous material 120 may be a sheet-like structure including a plurality of pores (not shown in Figures). The porous material 120 is mounted above the air inlet port 122 so that the air when routed into the housing 108 passes through the porous material 120 and thereafter fills within the housing 108. The air, when routed to the housing 108 filled with the water, disperses as air bubbles upon passing through the porous material 120. The air bubbles induce turbulent motion or turbulent mixing of water molecules with the air molecules, within the housing 108, wherein interfacial areas of the air bubbles and the turbulent mixing enhance evaporation of the water, thereby converting a portion of the water into water vapors. The water vapors when discharged from the housing 108 via the compressor unit 130 cool the remainder portion of the water to a cooled water, due to evaporative cooling. Further, the air bubbles being characterized by a larger interfacial area, aid in generation of the water vapors. The mechanism employed in the evaporator unit 102 for air bubble enhanced evaporation is further explained in this description.

In one embodiment, the mechanism for air bubble enhanced evaporation of 'water' in the evaporator unit 102 is described herein. According to the thermodynamic properties of water, liquid $H_2O$ molecules or water molecules evaporate spontaneously under reduced pressure. Meanwhile, the evaporated $H_2O$ molecules that escape from the surface carry away the internal energy of the liquid (heat of vaporization, $\Delta H$=40.6 kJ/mol). Thus, the evaporation of water, e.g., at 25° C., cools the remaining liquid into a state of lower temperature under reduced external pressure. Further, the equilibrium vapor pressure of $H_2O$ at 10° C. is determined to be 12 mbar. As such, water can be cooled to 10° C. eventually when the external pressure is maintained by a suitable device (a vacuum pump or a compressor) at this pressure. Also, due to the low vapor pressure of water in the refrigeration temperature range, a colossal volumetric flow rate of water vapor is generated. Thus, a matching pressure difference is required to be maintained in order to evacuate the water vapors, leaving behind cold water (cooled refrigerant) for maintaining the required refrigeration. In one implementation, for a vapor compression water chiller at 10° C. with a refrigeration capacity of 10 kW, the chiller is required to evacuate water vapor out of the evaporator at a rate of 25.7 $m^3$/min for maintaining the refrigeration capacity.

Further, the rate of evaporation is typically controlled kinetically. According to the kinetic theory of liquid vaporization, the rate of evaporation dN/dt is given by Eq. 1, as mentioned below.

$$\frac{dN}{dt} = -\frac{\Delta PAN_A}{\sqrt{2\pi MRT}}\exp(-E_{act}/RT) \quad \text{Eq. (1)}$$

where:

$\Delta P$ is the pressure difference between the equilibrated vapor at temperature T and the actual partial pressure of the liquid, '$N_A$' is the Avogadro number, 'M' is the molecular weight, 'R' is the gas constant, 'A' is the interfacial area between liquid and air phases, and $\exp(-E_{act}/RT)$ is the fraction of the liquid molecules which can escape from the liquid surface with high enough kinetic energy.

Further, the heat of vaporization is a thermodynamic bulk property of the liquid, it is anticipated that escaping molecules from the surface only experience the attractive potential from the domain of the liquid phase. Thus, the activation energy $E_{act}$ in Eq. (1) can be estimated to be half the value of $\Delta H$ and is given by 20 kJ/mol for water. Additionally, from Eq. (1), the evaporation rate of water at 300 K under vacuum is calculated to be $3.6\times10^{-2}$ mol/min, where the liquid-vacuum interface area is chosen to be 200 $cm^2$ and $E_{act}$ is 20 kJ/mol. Also, since a vapor compression water chiller or refrigeration system with a refrigeration capacity at 1 ton is thermally equivalent to a 5 mol/min evaporation rate of water, a direct pumping scheme on a limited interfacial area cannot be utilized in a practical device. As such, the interfacial area 'A' between the liquid and air phases is the only parameter which can be manipulated in Eq. (1). Further, in order to lift the constraints imposed on limited phase boundary areas, air flow is purposely introduced into the housing 108 through the porous material 120. In one implementation, 0.02 mol/s of air is introduced within the housing 108 such that the air mass is dispersed by the porous material 120 into air bubbles. In one implementation, if these bubbles flow through water within is and their diameter is 1 um, the interface area between air bubbles and liquid water is estimated to be $1.2\times10^5$ $cm^2$ at any instant.

Further, according to Eq. (1), the air bubbles expand larger under the lower pressure. Thus, lower the pressure maintained in the evaporator unit 102, greater is the size of the air bubble. Moreover, even for moisture-saturated air, the partial pressure of water vapor inside the inflated bubbles will be diminished to one-tenth of its original magnitude. Since the partial pressure of water in this scenario is lower than that in the equilibrated state at 0° C., ΔP in Eq. (1) is a positive definite value at 0° C. This fact implies that air can be directly drawn from the environment without dehumidification and be employed to cool down water all the way to 0° C., as long as the compressor unit 130 maintains the pressure ratio to raise the water pressure from 4.6 mbar to above 1 bar. The compressed air can thus be expelled to the outside world directly. Additionally, the pressure difference across the porous material 216 due to the pumping action on the air phase above the bulk water or the cooled water generates air bubbles spontaneously. The upward flowing of inflated air bubbles and their mutual interactions in the evaporator causes a turbulent motion of the water mass. The turbulence results in efficient mixing of phase boundary between air bubbles and liquid water. The turbulent motion induces a better probability for the high energy molecules inside the liquid phase to reside on the phase boundary surface. This efficient mixing process of air bubbles with liquid mass, which agitates high energy $H_2O$ molecules to the interfacial area, is essential to the cooling efficiency of the system 100. The bulk water or the cooled water, left subsequent to the evaporation process and evacuation of the water vapors, is circulated for refrigeration and/or air-conditioning of the enclosure 106.

Figure 3:
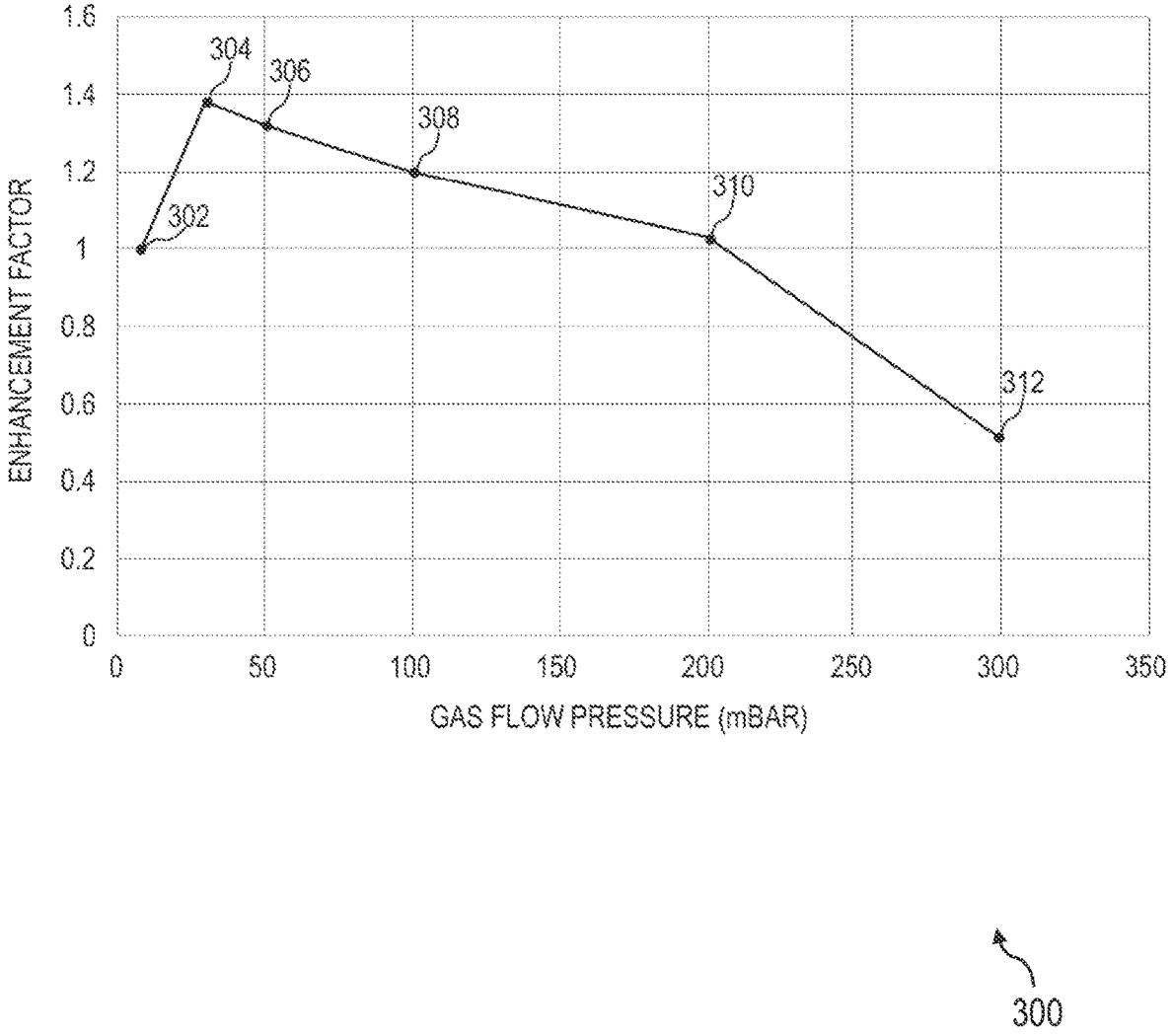
FIG. 3 is a graphical presentation of variation of air bubble enhanced evaporation with air flow pressure, in accordance with an example embodiment of the present disclosure.

In an embodiment, the air bubble enhanced evaporation process of the water corresponds to higher air flow pressures within the evaporator unit 102 (for e.g. as illustrated in FIG. 3). This is due to the fact that, the conventional refrigeration systems, employ turbo compressors in vacuum enclosures for transporting the refrigerant. The turbo compressors are configured with larger pumping capacities and have a limitation in the pressure ratios, which therefore requires these turbo compressors to be operated in a vacuum enclosure. Typically, with a few hundred mbar total vapor pressure within the evaporator, a single turbo compressor with a pressure ratio of around 3.5 can increase the exit pressure above 1 bar. Thus, it enables the compressed gases to be expelled from the evaporator unit 102 to the ambient surroundings. Such a requirement is mitigated in the present invention by employing the air bubble enhanced evaporation process. Referring to FIG. 3, a graphical representation 300 illustrating variation of evaporation rate of the water with air flow pressure, is provided. The graphical representation 300 is resultant of multiple tests carried out by measuring cooling rate of the evaporator unit 102 from 27° C. to 10° C. for different air flow pressures. The cooling rate of the evaporator unit 102 can be judged by the 'enhancement factor'. The enhancement factor is defined to be the ratio of time taken by the evaporator unit 102 to cool from 27° C. to 10° C. at a given air flow pressure, with the time taken by the evaporator unit 102 to cool from 27° C. to 10° C. at a 8 mbar air flow pressure. Further, for each measurement, a volume of about 300 mL of tap water was utilized, while a pressure measuring device (not shown in Figures) monitored a downstream pressure of the evaporator unit 102. The flow rate of the air into the evaporator unit 102 was controlled manually. When the air flow into the evaporator unit 102 was restricted, the downstream pressure of the evaporator unit 102 was measured to be 8 mbar and the resulting cooling enhancement factor was chosen to be 'unity' (e.g., see '302'). As the air flow pressure increased to about 40 mbar, the enhancement factor also increased to about 1.4 (e.g., see '304'). Thus, it is imperative that at higher air flow rates, the rate of cooling of the evaporator unit 102 increases. Consequently, the time taken for generating the cooled water also decreases. As such at higher air flow pressures, referenced as 306-312, the enhancement factors may be improved.

The housing 108 further includes an evaporator outlet port 124 mounted to a top portion 108*d* of the housing 108, for discharging the mixture of the air and the water vapours to ambient environment or surroundings. The evaporator outlet port 124 is preferably positioned on the top portion 108*d*, as the mixture of the air and the water vapors occupy the top portion 108*d*. This eases the process of discharge of the mixture of the air and the water vapors from the housing 108. Referring to FIG. 2, a plurality of baffle plates 126 are mounted proximal to the evaporator outlet port 124 for preventing splashing of the water during the turbulent mixing. In an embodiment, each of the plurality of baffle plates 126 is configured to be a plate-like structure, configured to prevent splashes of the water during its turbulent mixing. Each of the plurality of baffle plates 126 may be mounted on opposite sides within the housing 108, such that, a path between their ends may be provisioned. This configuration inherently prevents splashing of the water within the evaporator outlet port 124 during the turbulent mixing. In an embodiment, the baffle plates 126 may form a zig-zag configuration, a cascaded configuration or any other configuration which prevents splashing of the water during the turbulent mixing. Further, the housing 108 includes a sensor 128 configured to monitor the temperature of the water. In one configuration, the sensor 128 may be configured to monitor the temperature of the cooled water.

Referring back to FIG. 1, the heat exchanger unit 104 is configured within the evaporator unit 102 and is coupled to the enclosure 106 via a conduit 132. The conduit 132 may be coupled to another heat exchanger 134 configured within the enclosure 106. The conduit 132 may be a closed circuit, filled with water or any other suitable fluid for heat transfer between the evaporator unit 102 and the enclosure 106. A pump 136 may be configured to the conduit 132, for circulating the water therein. The circulation of water within the conduit 132, enables heat transfer between the evaporator unit 102 and the enclosure 106. In one configuration, the heat exchanger 134 is fluidically coupled to the enclosure 106 and may be positioned outside the enclosure 106 (not shown in Figures). Thus, the enclosure 106 is refrigerated via the evaporator 102.

In one configuration, the enclosure 106 may be one of a water container unit, a food storage compartment and an indoor space. In one implementation, the system 100 with the enclosure 106 of the water container unit type, corresponds to a water chiller unit, which may be configured with a water storage tank including tap water to be chilled or refrigerated. In another implementation, the system 100 with the enclosure 106 of the food storage compartment type corresponds to a refrigeration unit, which is required to be refrigerated for preserving food products stored therein. In yet another implementation, the system 100 with the enclosure 106 of the indoor space type is an air-conditioning system, which requires the indoor space to be conditioned.

Figure 2:
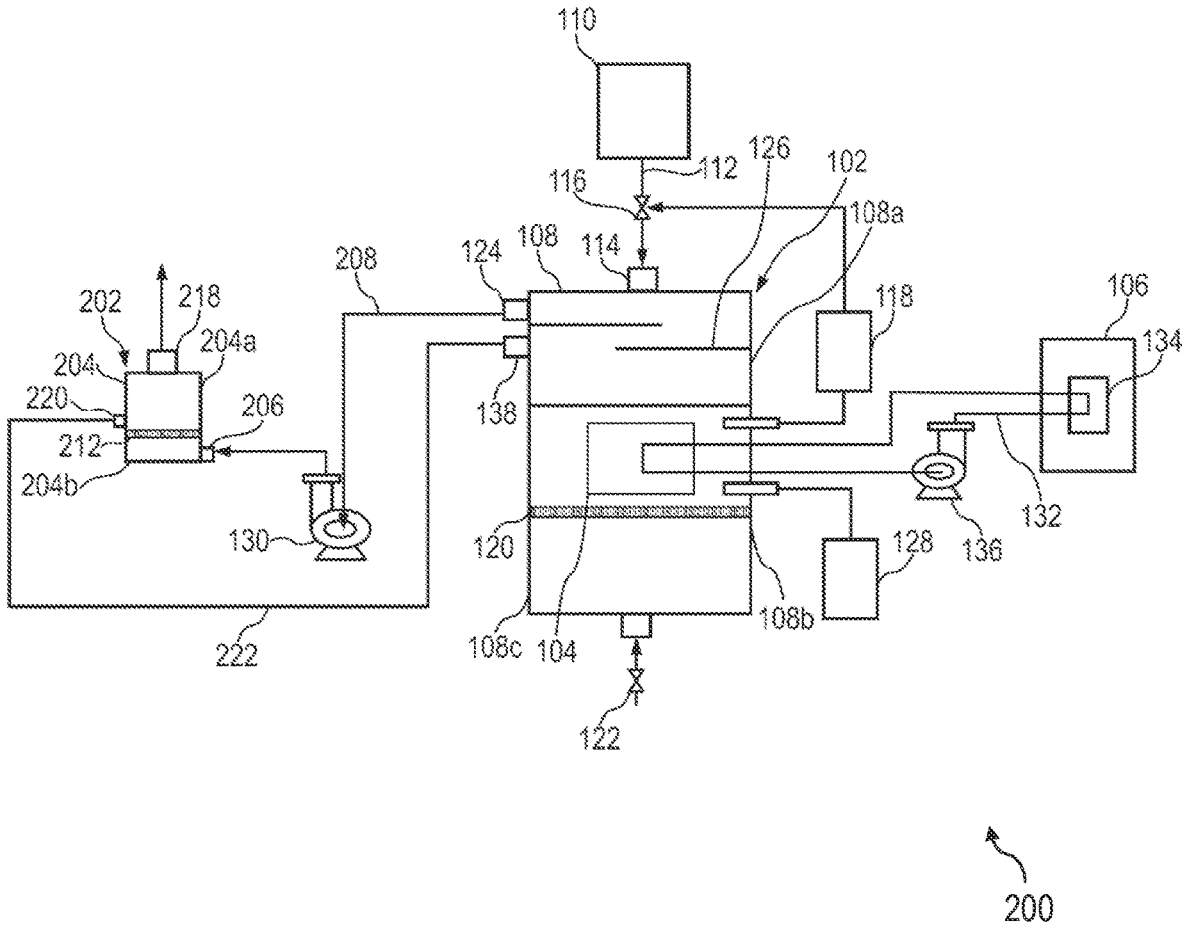
FIG. 2 is a schematic view of the refrigeration system coupled to a condenser unit for recycling and recirculating the water, in accordance with an example embodiment of the present disclosure.

FIG. 2 illustrates a schematic view of a refrigeration system 200, in accordance with an example embodiment of the present disclosure. The system 200 is configured with the evaporator unit 102 and the heat exchanger 104 of FIG. 1 along with a condenser unit 202. The condenser unit 202 is configured for condensing the water vapors and recirculating the condensed water to the evaporator unit 102. The condenser unit 202 includes a casing 204, to which a condenser inlet port 206 is mounted at its bottom portion 204*b* and coupled to the evaporator outlet port 124 for receiving the mixture of the air and the water vapors. The condenser inlet port 206 is fluidically coupled to the evaporator outlet port 124 via a conduit 208. The conduit 208 may include the pump or the compressor unit 130 configured to route the mixture of the air and the water vapors from the evaporator unit 102. The pump 130 may be configured with a relatively higher-pressure ratio between the evaporator outlet 124 and the condenser inlet port 206, for ease of routing the mixture of the air and the water vapors. In one configuration, the pump 130 may maintain a vacuum pressure of 12 mbar in the evaporator unit 102, for receiving the air into the evaporator unit 102. The action of pump 130 generates the air bubbles required for the process of the air bubble enhanced evaporation. In one implementation, the configuration of the pump 130 may be selected based on the enclosure 106 employed in the system 100 or 200. In another implementation, the configuration of the pump 130 may be selected based on the refrigeration effect required for the system 200. In another embodiment, the pump 130 may be selected from group such as but not limited to screw pump, maglev turbo compressor or any other oil-less pumping device as per feasibility and requirement. In an embodiment, the condenser unit 202 is a bubble column condenser unit. In another embodiment, the condenser unit 202 is a water-spray condenser. In one implementation, commercial screw vacuum pumps are employed in the system 100 or 200. The screw vacuum pumps may deliver high pressure ratios to compress air and expel them to the outside world. Also, the pumping speed of the screw vacuum pumps is high to provide a coefficient of performance of 6.25, which is superior than conventional water chillers.

The casing 204 also includes a sparger plate 212 disposed towards the bottom portion 204*b* of the casing 204, so that the mixture of the air and the water vapors pass through the sparger plate 212 prior to filling the casing 204. The sparger plate 212, similar to the porous material 120, further disperses the mixture of the air and the water molecules. The dispersion generates air bubbles with trapped water molecules inside. The air bubbles along with the water molecules rise up within the casing 204. Further, due to the lower temperature of the casing 204, the water vapors in the air bubbles condense to form liquid water, which settles down on the sparger plate 212 or on the bottom portion 204*b*. Thus, the water are recycled back to utilize as the refrigerant. For enhancing the condensation process in the condenser unit 202, a heat exchanger (not shown in Figures) may be mounted within the casing 204. In an embodiment, the casing 204 may be filled with a coolant for enhancing the rate of condensation of the water molecules within the casing 204.

A first condenser outlet 218 is positioned on the top portion 204*a* of the casing 204 for ease of discharging the air to the surroundings, as the air being less dense, floats in the top portion 204*a* of the casing 204. The casing 204 further includes a second condenser outlet 220 mounted to the casing 204, preferably to the bottom portion 204*a* of the housing 204. The second condenser outlet 220 is configured to discharge the condensed water from the casing 204 into the evaporator unit 102. The second condenser outlet 220 is coupled to an inlet port 138 of the evaporator unit 102 via a tube 222, which may include a valve (not referenced in Figures), for ensuring recirculation of the water in the system 200. The valve may be communicatively coupled to the control unit. The control unit is configured to operate the valve suitably, for controlling the rate of discharge of the water from the condenser unit 202 to the evaporator unit 102. In one configuration, the tube 222 may extend and connect to the reservoir 110, for recirculating the condensed water into the reservoir 110 (not shown in Figures).

In one configuration, the size and configuration of the conduits or tubes employed in the system 100/200 (for e.g. conduits 112, 132 and 222) are selected based on the flow rate or the desired discharge rate. In an embodiment, the conduits 112, 132 and 222 may be selected as a single joint configuration, to prevent possible loss of flow associated with multiple joints.

In an embodiment, the housing 202, the casing 204, the baffle plates 126 and the porous material 120 are made of stainless-steel material, due to its inherent anti-corrosive properties, thermal conductivity and high strength to weight ratio. Alternatively, the evaporator unit 102, the condenser unit 202, the baffle plates 126 and the porous material 120 can be made of other materials as per feasibility and requirement. In an embodiment, the porous material 120 is porous disk made of stainless-steel grade material.

Thus, various embodiments of the present disclosure provide systems 100/200 for employing water as the refrigerant, without the use of cumbersome equipment, required for maintaining working conditions to use water as the refrigerant.

What is claimed is:

1. A refrigeration system, comprising:

an evaporator unit, comprising:

a housing configured to receive water and including an air inlet port configured to route air into the housing from ambient surroundings, and a porous material disposed at a bottom portion of the housing for defining a first compartment and a second compartment within the housing, the first compartment configured to receive the water and the second compartment configured to receive the air through the air inlet port, the porous material positioned above the air inlet port for allowing the air into the housing through the porous material, the air routed through the porous material dispersing within the housing to form air bubbles, the air bubbles inducing turbulent mixing between phase boundaries of water molecules and air molecules within the housing, wherein interfacial areas of the air bubbles and the turbulent mixing enhance evaporation rate of the water, thereby converting a portion of the water into water vapors leaving a remainder portion of water, wherein the water vapors on discharging from the housing cool the remainder portion of the water via evaporative cooling to form cooled water, and wherein the cooled water is settled on the porous material;

an evaporator outlet port physically coupled to a top portion of the housing, for discharging a mixture of the air and the water vapors from the housing;

a plurality of baffle plates mounted proximal to the evaporator outlet port for preventing splashing of the water during the turbulent mixing, the plurality of baffle plates mounted such that each baffle plate is mounted on an opposite side of the top portion of the housing, wherein one end of each baffle plate is physically coupled to the top portion of the housing and an other end is a free end disposed within the housing, such that, a path between the free ends may be provisioned;

a compressor unit physically coupled to the housing at the evaporator outlet port and configured to induce an evacuation action within the housing, the evacuation action enabling the air to enter the housing from the ambient surroundings via the air inlet port; and a heat exchanger unit physically coupled to the housing and to an enclosure, the heat exchanger unit configured to refrigerate the enclosure; and wherein the evaporator unit employs air bubble enhanced evaporation of water for maintaining required refrigeration.

2. The system as claimed in claim 1, further comprising a reservoir coupled to the first compartment of the housing, the reservoir configured to supply the water to the housing.

3. The system as claimed in claim 2, further comprising an evaporator inlet port physically coupled to the first compartment of the housing and coupled to an outlet port of the reservoir, the evaporator inlet port configured to receive the water from the reservoir.

4. The system as claimed in claim 1, wherein the heat exchanger unit includes a heat exchanger within the evaporator and includes a conduit physically coupled to the enclosure, the conduit is a closed circuit, filled with water for heat transfer between the evaporator and the enclosure, upon circulation.

5. The system as claimed in claim 1, further comprising a condenser unit, wherein a condenser inlet port positioned at a bottom portion of the condenser unit is coupled to the evaporator outlet port for receiving the mixture of the air and the water vapors, wherein the condenser unit is configured to condense the water vapors into the water.

6. The system as claimed in claim 5, further comprising a sparger plate mounted within the condenser unit and disposed proximal to the condenser inlet port, the sparger plate being configured to induce bubbles of the water vapors when the water vapors are routed via the condenser inlet port.

7. The system as claimed in claim 1, further comprising a first condenser outlet port positioned at a top portion of a condenser unit, the first condenser outlet port configured to discharge the air from the condenser unit.

8. The system as claimed in claim 7, further comprising a second condenser outlet port physically coupled to the first compartment of the evaporator unit, for recirculating the water condensed from the water vapors into the evaporator unit.

9. The system as claimed in claim 1, wherein the porous material is a perforated sheet structure extending along an inner periphery of the housing.

10. The system as claimed in claim 1, wherein the enclosure is one of:

a fluid container unit;

a food storage compartment; and an indoor space.

11. A refrigeration system, comprising: an evaporator unit, comprising:

a housing configured to receive water and including an air inlet port configured to route air into the housing from ambient surroundings, and a porous material disposed at a bottom portion of the housing for defining a first compartment and a second compartment within the housing, the first compartment configured to receive the water and the second compartment configured to receive the air through the air inlet port, the porous material positioned above the air inlet port for allowing the air into the housing through the porous material, the air routed through the porous material disperses within the housing to form air bubbles, the air bubbles inducing turbulent mixing between phase boundaries of water molecules and air molecules within the housing, wherein interfacial areas of the air bubbles and the turbulent mixing enhance evaporation rate of the water, thereby converting a portion of the water into water vapors leaving a remainder portion of water, the water vapors on discharging from the housing cool the remainder portion of the water via evaporative cooling to form cooled water, and wherein the cooled water is settled on the porous material;

an evaporator outlet port physically coupled to a top portion of the housing for discharging a mixture of the air and the water vapors from the housing;

a plurality of baffle plates mounted proximal to the evaporator outlet port for preventing splashing of the water during the turbulent mixing, wherein each of the plurality of baffle plates is mounted on an opposite side of the top portion of the housing, wherein one end of each baffle plate is physically coupled to the top portion of the housing and an other end is a free end disposed within the housing, such that, a path between the free ends may be provisioned;

a compressor unit physically coupled to the housing at the evaporator outlet port and configured to induce an evacuation action within the housing, the evacuation action enabling the air to enter the housing from the ambient surroundings via the air inlet port; and a heat exchanger unit physically coupled to the housing and to an enclosure, the heat exchanger unit including a heat exchanger configured to air-condition the enclosure; and wherein the evaporator unit employs air bubble enhanced evaporation of water for maintaining required refrigeration.

12. The system as claimed in claim 11, further comprising a reservoir coupled to the first compartment of the housing for supplying the water.

13. The system as claimed in claim 11, further comprising a condenser inlet port positioned at a bottom portion of a condenser unit and coupled to the evaporator outlet port for receiving the mixture of the air and the water vapors, wherein the condenser unit is configured to condense the water vapors into the water.

14. The system as claimed in claim 11, further comprising a first condenser outlet port positioned at a top portion of a condenser unit, the first condenser outlet port configured to discharge the air from the condenser unit.

15. The system as claimed in claim 14, further comprising a second condenser outlet port physically coupled to the first compartment of the evaporator unit, for recirculating the water condensed from the water vapors into the evaporator unit.

16. An air conditioning system, comprising:

an evaporator unit, comprising:

a housing configured to receive water and including an air inlet port configured to route air into the housing from ambient surroundings, and a porous material disposed at a bottom portion of the housing for defining a first compartment and a second compartment within the housing, the first compartment configured to receive the water and the second compartment configured to receive the air through the air inlet port, wherein, the porous material is positioned above the air inlet port for allowing the air into the housing through the porous material, the air routed through the porous material disperses within the housing to form air bubbles, the air bubbles inducing turbulent mixing between phase boundaries of water molecules and air molecules within the housing, wherein interfacial areas of the air bubbles and the turbulent mixing enhance evaporation rate of the water, thereby converting a portion of the water into water vapors leaving a remainder portion of water, the water vapors on discharging from the housing cool the remainder portion of the water via evaporative cooling to form cooled water, and wherein the cooled water is settled on the porous material;

an evaporator outlet port physically coupled to a top portion of the housing for discharging a mixture of the air and the water vapors from the housing;

a plurality of baffle plates mounted proximal to the evaporator outlet port for preventing splashing of the water during the turbulent mixing, wherein each of the plurality of baffle plates is mounted on an opposite side of the top portion of the housing, wherein one end of each baffle plate is physically coupled to the top portion of the housing and an other end is a free end disposed within the housing, such that, a path between the free ends may be provisioned;

a compressor unit physically coupled to the housing at the evaporator outlet port and configured to induce an evacuation action within the housing, the evacuation action enabling the air to enter the housing from the ambient surroundings via the air inlet port;

a heat exchanger unit physically coupled to the housing and to an enclosure, the heat exchanger unit configured to air-condition the enclosure via a heat exchanger within the evaporator and another heat exchanger within the enclosure; and wherein the evaporator unit employs air bubble enhanced evaporation of water for maintaining required refrigeration.

17. The system as claimed in claim 16, wherein the heat exchanger unit includes a conduit physically coupled to the heat exchanger within the evaporator and the heat exchanger within the enclosure; and the conduit is a closed circuit, filled with water for heat transfer between the evaporator and the enclosure, upon circulation.

* * * * *